US008113027B2

(12) United States Patent
McDonald et al.

(10) Patent No.: US 8,113,027 B2
(45) Date of Patent: Feb. 14, 2012

(54) METHOD AND DEVICE FOR THE MANUFACTURE OF MULTIPLE GROOVED WIRE

(75) Inventors: Daniel P. McDonald, Palatine, IL (US); Richard A. C. Shepard, Mississauga (CA)

(73) Assignee: Illinois Tool Works Inc., Glenview, IL (US)

( * ) Notice: Subject to any disclaimer, the term of this patent is extended or adjusted under 35 U.S.C. 154(b) by 450 days.

(21) Appl. No.: 12/364,933

(22) Filed: Feb. 3, 2009

(65) Prior Publication Data

US 2009/0266132 A1 Oct. 29, 2009

Related U.S. Application Data

(60) Provisional application No. 61/047,155, filed on Apr. 23, 2008.

(51) Int. Cl.
*B21B 13/10* (2006.01)
*B21B 35/00* (2006.01)

(52) U.S. Cl. ..... 72/234; 72/235; 72/249; 148/641

(58) Field of Classification Search ..... 72/234, 72/235, 237, 241.2, 241.4, 242.2, 242.4, 72/243.4, 249; 148/641, 643
See application file for complete search history.

(56) References Cited

U.S. PATENT DOCUMENTS

| | | | | |
|---|---|---|---|---|
| 340,692 | A | 4/1886 | Bailey | |
| 4,637,768 | A | 1/1987 | Rabe | |
| 4,800,746 | A | 1/1989 | Potucek | |
| 5,542,886 | A | 8/1996 | Scott et al. | |
| 5,953,948 | A * | 9/1999 | Isozaki | 72/224 |
| 6,397,650 | B1 * | 6/2002 | Sakurai et al. | 72/224 |
| 2007/0160442 | A1 | 7/2007 | Reynolds | |

FOREIGN PATENT DOCUMENTS

| | | |
|---|---|---|
| DE | 509511 | 10/1930 |
| DE | 1813179 | 6/1970 |
| EP | 0076244 | 4/1983 |
| EP | 0576034 | 12/1993 |
| FR | 2282305 | 3/1976 |
| FR | 2418369 | 9/1979 |
| JP | 2004144121 | 5/2004 |

OTHER PUBLICATIONS

International Search Report dated May 30, 2008 for PCT/US2008/053063.

International Search Report for PCT/US2009/036641 dated Jul. 9, 2009.

* cited by examiner

*Primary Examiner* — David Jones
(74) *Attorney, Agent, or Firm* — Levenfeld Pearlstein, LLC

(57) ABSTRACT

A plurality of rollers for producing longitudinal grooves in an elongated metal substrate, the plurality of rollers comprising a first set and a second set of rollers, the plurality of rollers having groove-forming fluted edges thereon. The plurality of rollers are aligned circumferentially around and parallel to a longitudinal axis of the elongated metal substrate, wherein the plurality of rollers are configured to produce an odd number of grooves distributed asymmetrically about a circumference of the elongated metal substrate.

20 Claims, 12 Drawing Sheets

SECTION IV-IV

SECTION V

SECTION VI-VI

SECTION VI-VI

SECTION X

SECTION XIV-XIV

METHOD AND DEVICE FOR THE MANUFACTURE OF MULTIPLE GROOVED WIRE

CROSS-REFERENCE TO RELATED APPLICATIONS

This application claims the benefit of priority to Provisional U.S. Patent Application Ser. No. 61/047,155, filed Apr. 23, 2008, entitled "MULTIPLE GROOVED WIRE."

BACKGROUND OF THE INVENTION

The claimed invention is directed to a grooved wire. More particularly, the invention pertains to a method and device for manufacturing wire having an odd number of grooves.

Round wire has been produced for hundreds of years. Not only is round wire the easiest type of wire to manufacture, the symmetrical shape of round wire exhibits predictable, uniform properties in any direction when used to bear mechanical loads, carry electricity, and propagate telecommunication signals. Such properties include a wire's bending yield strength in response to a shear load.

The majority of the cost of manufacture of wire comes from the raw materials used to make the wire. As the cost of the raw materials rises, however, it is desirable to minimize manufacturing costs by creating wire which uses less material to form the wire without significantly compromising the desirable properties of the wire, such as bending yield strength.

Currently, there exist methods to make 4, 6, and 8-groove wire using identical rollers which create grooved sections of wire that are directly opposed to one another. It would be desirable, however, to create a wire configured in which the grooved edge is directly opposite to a protruding edge to enable the wire to resist a shear load applied to a grooved side of the wire using its non-grooved counterpart.

BRIEF SUMMARY OF THE INVENTION

Longitudinal grooves in an elongated metal substrate are produced by pulling the metal substrate through a plurality of rollers. The rollers have groove-forming protrusions thereon and are aligned circumferentially around and parallel to a longitudinal axis of the elongated metal substrate, hereinafter referred to as "wire". The rollers are configured to produce an odd number of grooves distributed asymmetrically about a circumference of the wire.

The plurality of rollers includes at least a first set of rollers and a second set of rollers. The first set of rollers produces an odd number of grooves and the second set of rollers produces an even number of grooves in the wire, although the order may be changed depending on the configuration of the rollers. The first set of rollers is off-set of the second set of rollers. The second set of rollers produces grooves at gaps between the grooves formed by the first set of rollers.

Flashing is reduced in the grooves formed by the first set of rollers. There are at least as many gaps between rollers of the first set of rollers as there are grooves formed by the second set of rollers. The protrusions of the second set of rollers are configured to straddle the grooves formed by the first set of rollers.

In one method, the wire is drawn through the roller set in which a first roller in the plurality of rollers has a different number of groove-forming protrusions than a second roller in the plurality of rollers. Each roller in the plurality of rollers produces full-radius grooves or non-full radius grooves.

The method can include drawing the wire through rollers can be configured such that each roller in the plurality of rollers produce grooves having a V-shaped cross-section, a rounded cross-section, a square cross-section, or other compatible configuration.

In drawing the wire through the rollers, each roller in the plurality of rollers produces ridges in the elongated metal substrate. The plurality of rollers produce grooves that may be spaced uniformly or non-uniformly around a circumference of the elongated metal substrate. The plurality of rollers produce ridges having a rounded or pointed peak or combination thereof.

BRIEF DESCRIPTION OF THE SEVERAL VIEWS OF THE DRAWINGS

The benefits and advantages of the claimed invention will become more readily apparent to those of ordinary skill in the relevant art after reviewing the following detailed description and accompanying drawings, wherein:

DETAILED DESCRIPTION OF THE INVENTION

Figure 1:
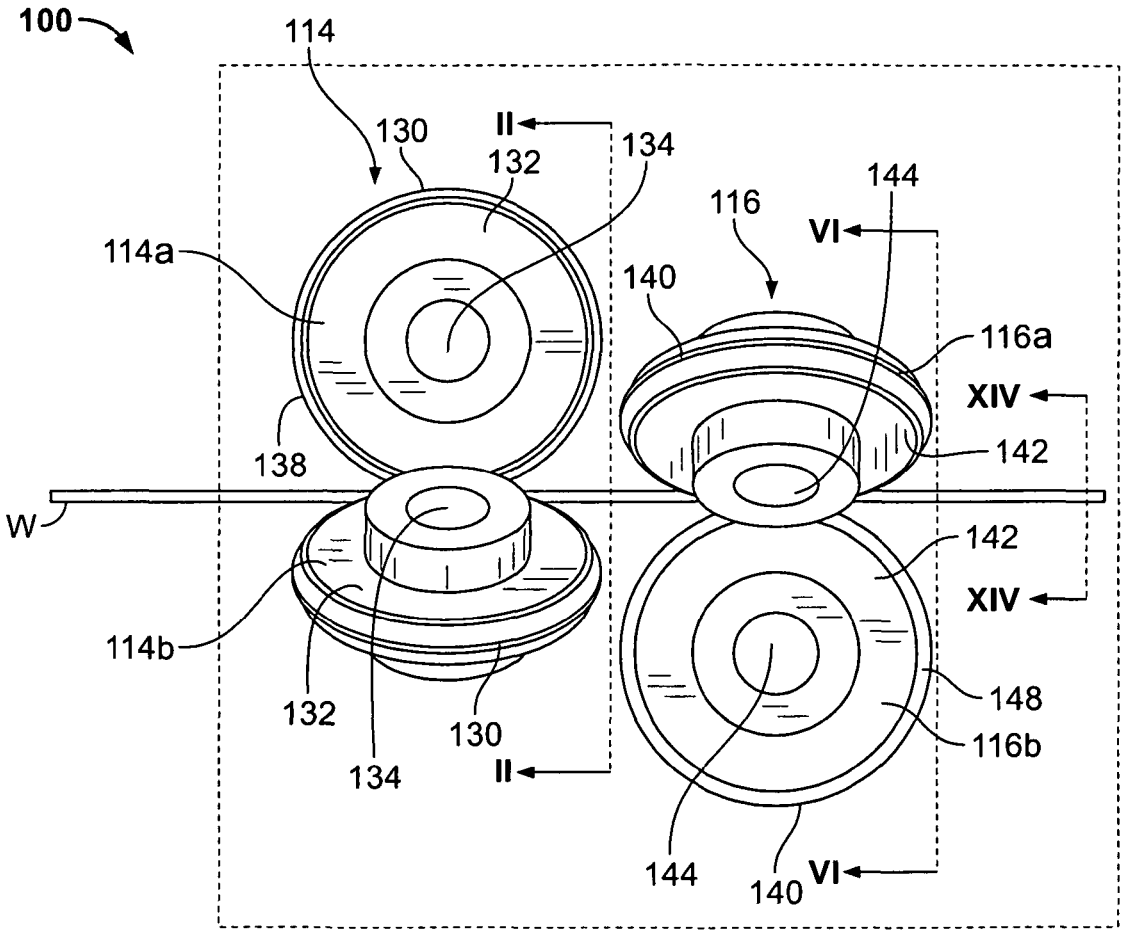
FIG. 1 is a perspective view of a wire being drawn between rollers to illustrate the method of the principles of the claimed invention.

While the claimed invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

The present disclosure describes a method and device for the manufacture of multiple grooved wire. A grooved fastener is disclosed in Shelton, U.S. patent application Ser. No. 11/958,670, filed Dec. 12, 2007, commonly assigned with the present application and incorporated herein by reference.

A method and apparatus for manufacturing multiple grooved wire uses, in a present embodiment, two sets of rollers to produce an odd numbered of grooves longitudinally along the length of a wire. As used herein, a wire is any metal substrate, preferably elongated, and includes hangars, nails, rods, fasteners, and other elongated metal substrates. Each set of rollers is comprised of three individual rollers. Each individual roller includes a disk-shaped body having a central axis about which a circular hub is circumferentially disposed. The disk-shaped body extends radially from the hub to a rim. The rim has a fluted edge configured for producing corresponding grooves and protrusions in a wire or nail.

Each set of rollers has a slightly different profile (relative to the other set of rollers) to produce a profiled wire having an odd number of grooves, such that the grooves are disposed asymmetrically around the circumference of the wire. Any bending or shear forces applied normal to a particular groove is resisted on the opposite side of the wire by a non-grooved, ridged section. Each set of rollers includes three rollers. The six rollers (in the two sets) produce an odd-numbered groove arrangement. Each of the grooves has a nadir (the lowest point of the groove) and the nadirs are not diametrically opposed to one another, that is, not 180 degrees opposed, thus, helping to prevent over-thinning of the wire. In addition, such configuration does not compromise the bending yield strength of the wire.

The two sets of rollers perform two functions simultaneously: they reduce the wire to its final diameter and form multiple grooves in the wire with one reduction pass through the sets of rollers. A single reduction pass eliminates the added expense of extra equipment to add grooves. The claimed invention can eliminate a considerable amount of the material needed to manufacture a wire. The claimed invention also reduces the material weight, and as such the material cost compared to round wire of comparable diameter. The groove-forming rollers may also be modified with shapes such as rings or protrusions to add additional elements to the wire. In some embodiments, rings or protrusions can be added to the grooves and/or to the circumference of the wire to add "holding power" to the wire. The rollers are made from tungsten carbide or other steel and/or similar materials and thus, have a long "roll" life before regrinding is necessary, significantly reducing tool changeover downtimes.

Turning now to the figures, and in particular FIG. 1, there is shown an illustration of groove-forming rollers for the manufacture of multiple grooved wire, in accordance with the presently claimed invention. A present embodiment for grooved rollers and a method of using same is herein described for the manufacture of wire having nine grooves. It is understood that the present grooved rollers can be configured to produce grooves of any odd number. The present disclosure uses a nine (9) groove wire as an exemplary embodiment. Those skilled in the art will understand and appreciate that sets of grooved rollers forming an odd-number of grooves is in keeping with the spirit of the claimed invention.

Figure 2:
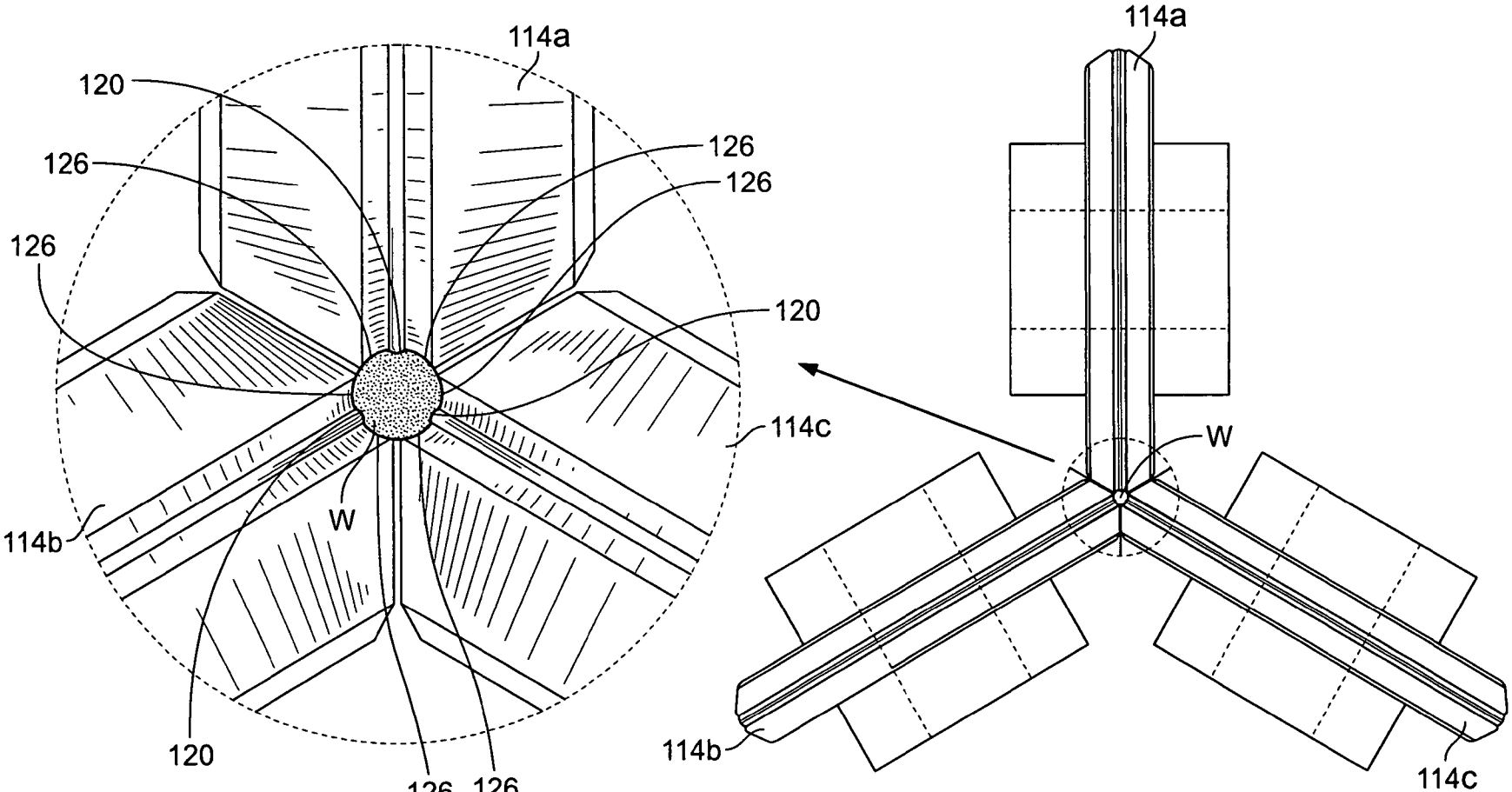
FIG. 2 is an enlarged view of FIG. 1 cross-section II-II.
Figure 3:
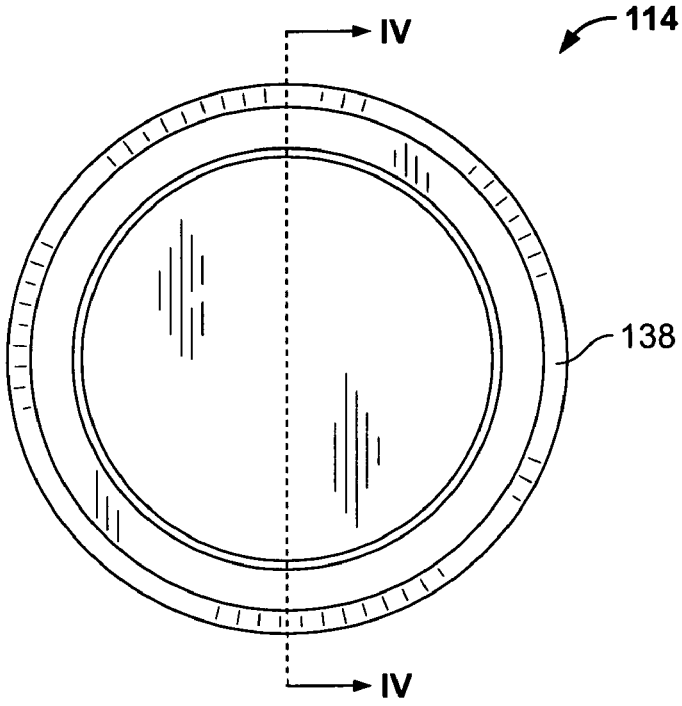
FIG. 3 is a front view of an inlet roller.
Figure 4:
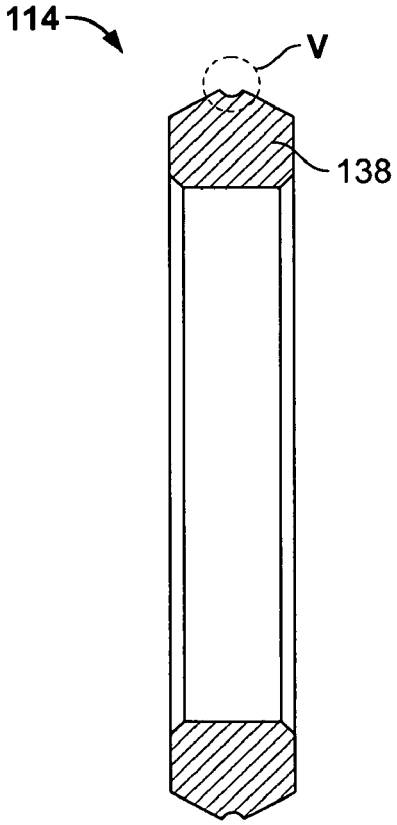
FIG. 4 is a cross-sectional view of section IV-IV of FIG. 3.
Figure 5:
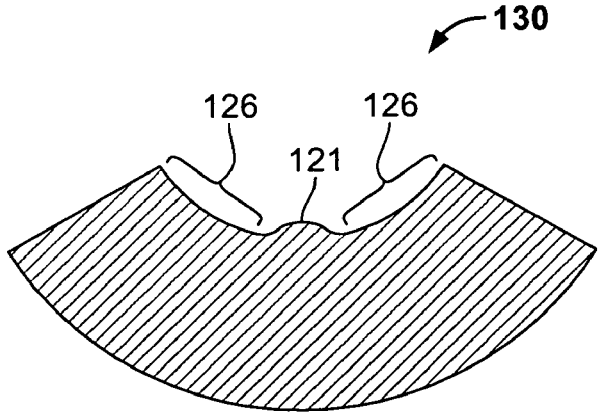
FIG. 5 is an enlarged side view of section V of FIG. 4.
Figure 6:
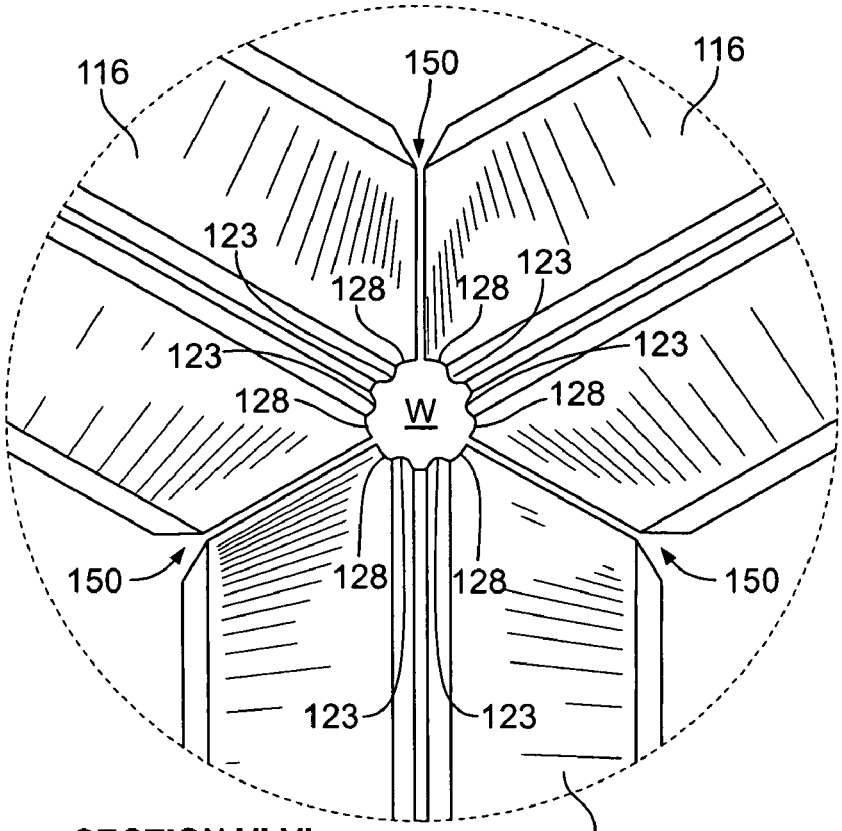
FIG. 6 is an enlarged view of section VI-VI of FIG. 1, without the grooves from the inlet rollers present.
Figure 7:
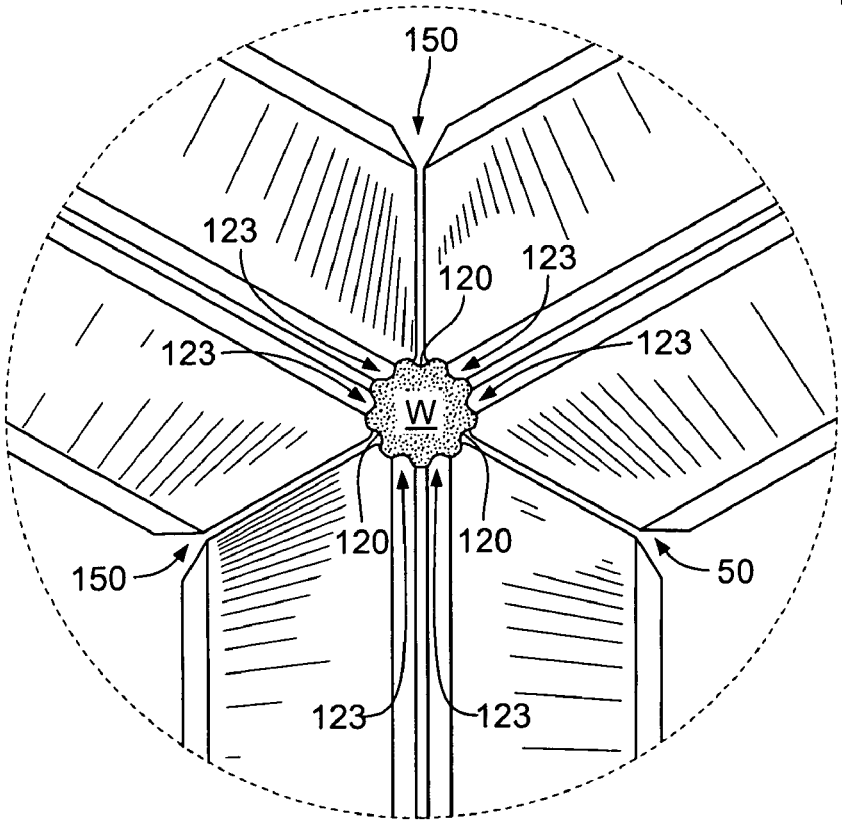
FIG. 7 is an enlarged view of section VI-VI of FIG. 1.
Figure 8:
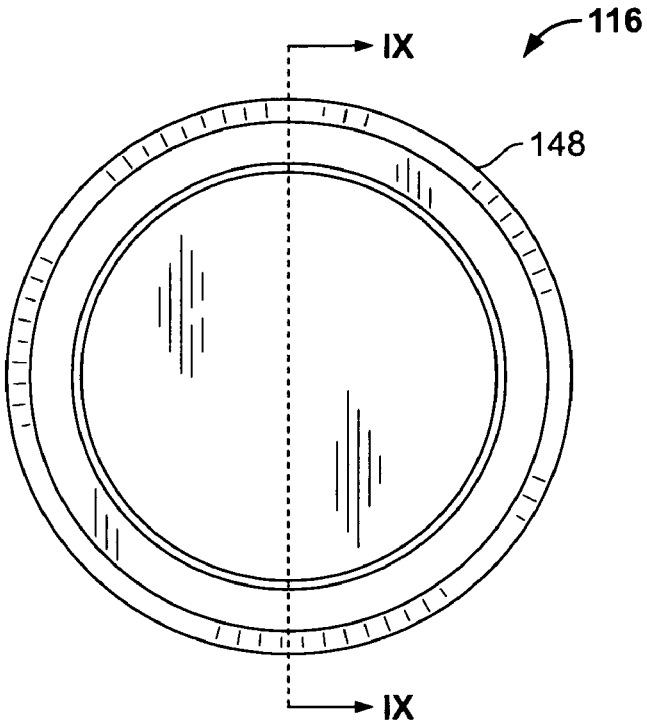
FIG. 8 is a front view of an embodiment of an outlet roller.
Figure 9:
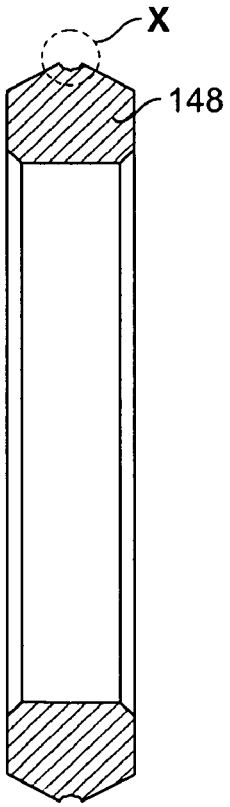
FIG. 9 is a section view XI-XI of FIG. 8.
Figure 10:
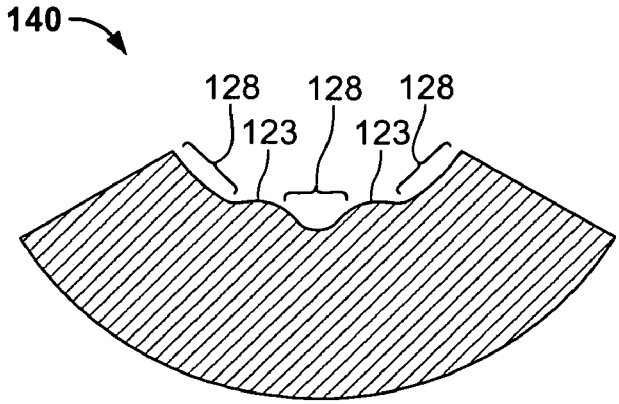
FIG. 10 is an enlarged view of section X of FIG. 9.
Figure 11:
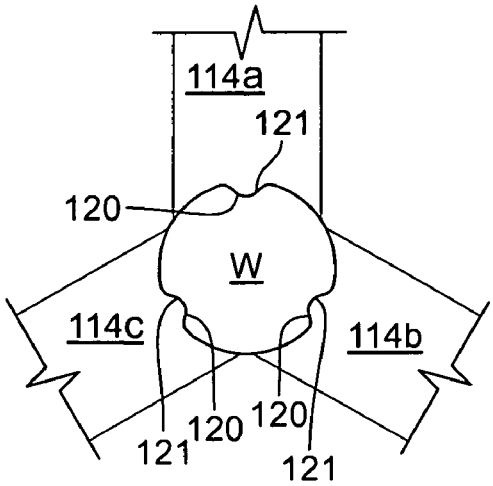
FIG. 11 is a cross-sectional view of a wire having passed through inlet rollers.
Figure 12:
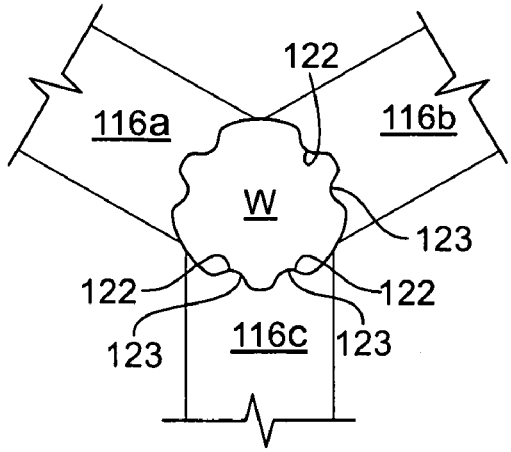
FIG. 12 is a cross-sectional view of a wire having passed through the embodiment of the outlet rollers.

In FIG. 1, there is illustrated a cassette 100 housing two sets of rollers, an inlet set of rollers 114 and an outlet set of rollers 116. While in the present embodiment a cassette is illustrated, it will be understood by those skilled in the art that a housing or cassette is not necessary and is shown only as an example of an embodiment of the claimed invention. The inlet set of rollers 114 includes three rollers, 114*a*, 114*b*, and 114*c*, as shown in FIG. 2. Inlet rollers 114*a*, 114*b*, and 114*c* are each placed 120 degrees apart from each other relative to the circumference of the wire W. Each individual roller 114*a*, 114*b*, 114*c* includes a disk-shaped body 132 having a central axis 134. The disk-shaped body 132 extends radially from the central axis 134 to a rim 138. The rim 138 has a fluted edge 130. FIGS. 3-5 illustrate an individual inlet roller 114. Each inlet roller in the present embodiment has a fluted edge 130 having a convex section 121 to produce one (1) groove 120 in the wire W. Thus, the three inlet rollers 114*a*, 114*b*, 114*c* together produce three corresponding grooves 120 in the wire W. As those skilled in the art will understand, the fluted edge 130 can be configured to produce any number of grooves in the wire, but that in the present embodiment, each of the inlet rollers 114 produces a single groove 120.

Similarly, the outlet set of rollers 116 includes three rollers, 116*a*, 116*b*, and 116*c*, as illustrated in FIGS. 6-13. The outlet rollers 116*a*, 116*b*, and 116*c* are each placed 120 degrees apart from each other relative to the circumference of the wire W. Each individual roller 116*a*, 116*b*, and 116*c* includes a disk-shaped body 142 having a central axis 144. The disk-shaped body 142 extends radially from the central axis 144 to a rim 148. The rim 148 has a fluted edge 140. FIGS. 6-13 illustrate an individual outlet roller 1 16. Each outlet roller in the present embodiment has a fluted edge having concave sections 128 and convex sections 123 which produces two (2) grooves 122 in the wire W. Thus, the three outlet rollers 116*a*, 116*b*, and 116*c* together produce six corresponding grooves 122 in the wire W. As those skilled in the art will understand, the fluted edge 140 can be configured to produce any number of grooves in the wire, but that in the present embodiment, each of the outlet rollers 116 produces two grooves 122 in wire W to produce six (6) grooves in the wire W.

Figure 13:
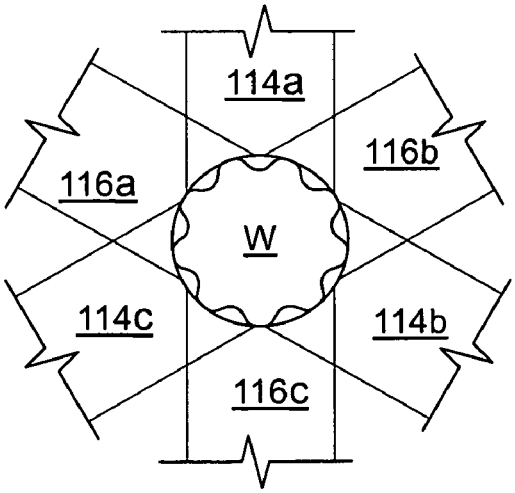
FIG. 13 is a cross-sectional view of a wire having passed through both inlet and the embodiment of outlet rollers.

The rollers 114, 116 are made from tungsten carbide or other steel or other similar material. The outlet set of rollers 116 is located sequentially after the inlet set of rollers 114 and are rotated in relation to the inlet set of rollers 114 such that the angle between an adjacent inlet roller 114 and an outlet roller 116 is approximately 60 degrees, as shown in FIG. 13.

Figure 14:
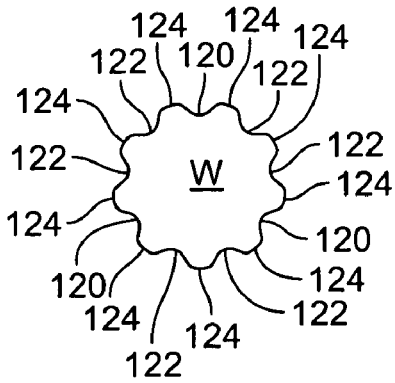
FIG. 14 is a cross-sectional view of an embodiment from section XIV-XIV of FIG. 1.

Grooves 120, 122 are formed in the wire W when the round wire W is drawn through the inlet set of rollers 114, then through the outlet set of rollers 116; the wire W then emerges as grooved wire W as shown in FIG. 14. The grooves 120 are formed around the circumference of the wire W, 120 degrees apart from each other and run parallel to each other along the longitudinal length of the wire W.

With grooves 120 formed on the wire W by the inlet set of rollers 114, the wire W passes through the outlet set of rollers 116. The outlet set of rollers 116 are positioned such that that the grooves 120, formed by the inlet rollers 114, fall between the gaps 150 between the rollers 116*a*, 116*b*, and 116*c*. Because the grooves 120 formed by the inlet rollers 114 fall between the gaps 150 of the outlet rollers 116, no material is present that could create a potential flash or seam in the area during formation of the grooves 122.

In addition to grooves 120, 122 being formed, ridges 124 are formed simultaneously. Ridges 124 separate each groove 120, 122 from one another and also provide resistance to any bending stresses applied to the grooves 120, 122. No two grooves are 180 degrees opposed to one another. A plurality of semicircular ridges 124 are disposed about the circumference of the wire W with at least one ridge 124 disposed between each of the grooves, as shown in FIG. 14.

The profile of the grooves 120 formed by the inlet set of rollers 114 is such that each groove 120 is a full-radius groove 120 in the wire W. When the grooves 122 formed by the outlet set of rollers 116 are also full-radius grooves 122, the final wire W shape is uniform around the circumference of the wire W, as shown in FIG. 14. Consequently, the ridges 124 formed are uniform in height.

In an exemplary embodiment of the grooved wire W in which both inlet rollers 114 and outlet rollers 116 are configured to form full-radius grooves, the radius (depth) of each groove 120, 122 is 0.01 inches, with the diameter of the grooved wire 0.118 inches. In this exemplary embodiment, a total of nine grooves 120, 122 are formed around the circumference of the wire W, the grooves uniformly disposed along the circumference, approximately forty (40) degrees apart.

Figure 15:
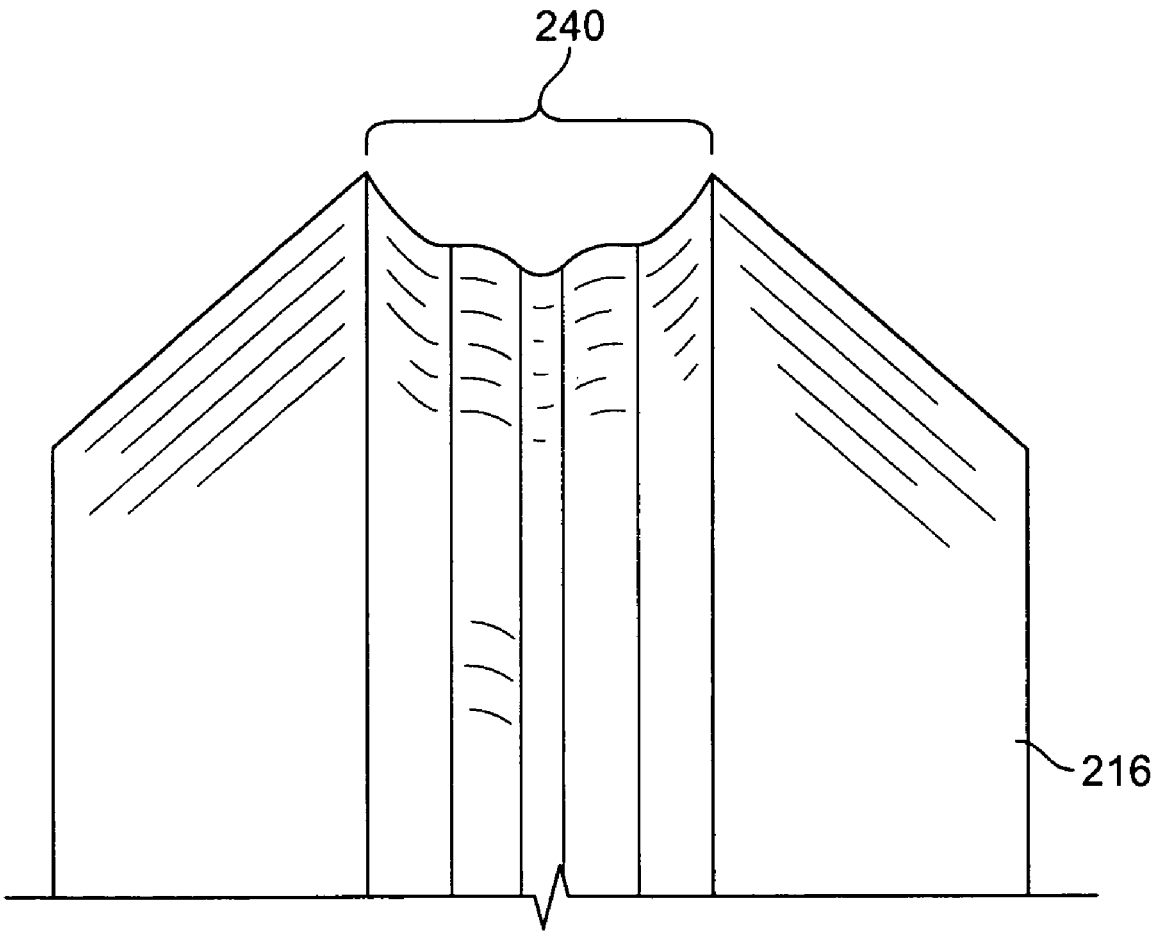
FIG. 15 is another embodiment of the outlet roller.
Figure 16:
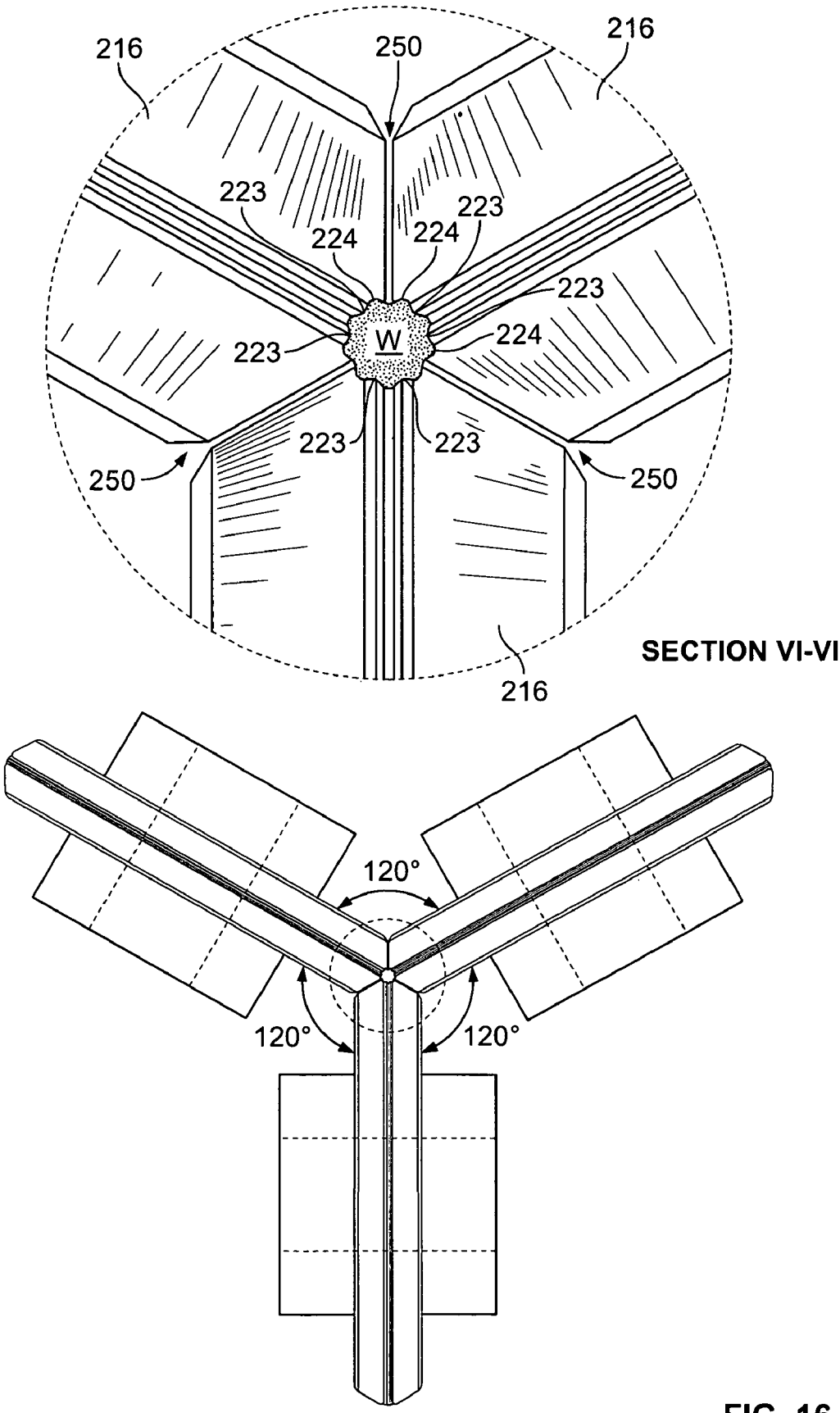
FIG. 16 is another embodiment of section VI-VI from the outlet roller of FIG. 15 creating a wire with flatter edges and wider radii.
Figure 17:
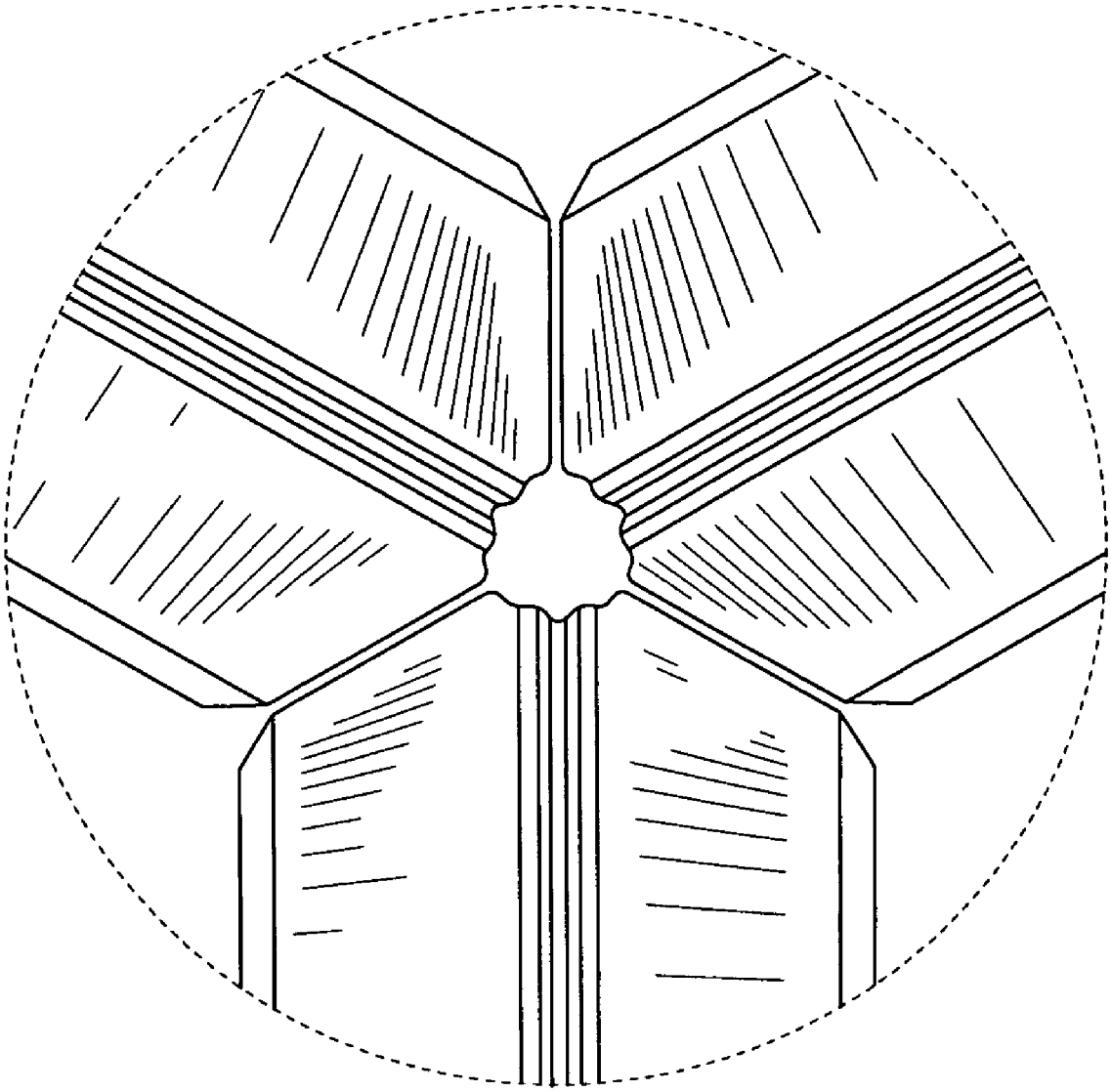
FIG. 17 is another cross-sectional view of the wire passing through the embodiment of the outlet roller of FIG. 15.
Figure 18:
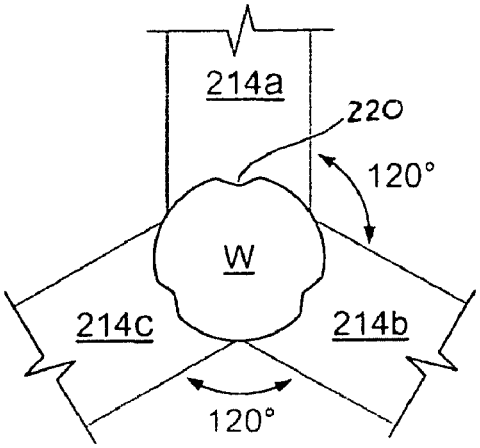
FIG. 18 is another embodiment of a cross-sectional view of a wire passing through inlet rollers.
Figure 19:
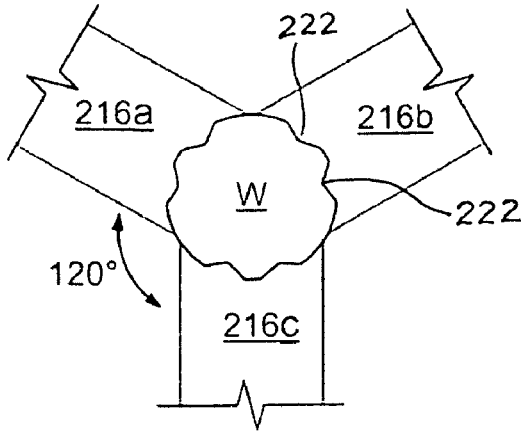
FIG. 19 is another embodiment of a cross-sectional view of a wire passing through the outlet rollers of FIG. 15.
Figure 20:
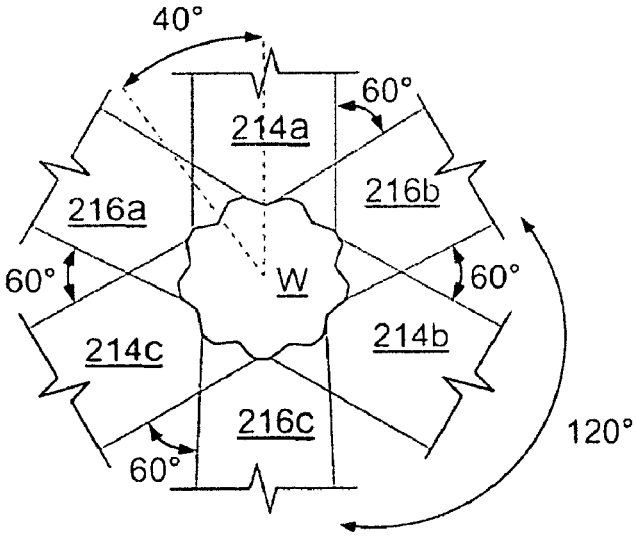
FIG. 20-21 are cross-sectional views of a wire having passed through inlet rollers and the embodiment of the outlet roller of FIG. 15.
Figure 21:
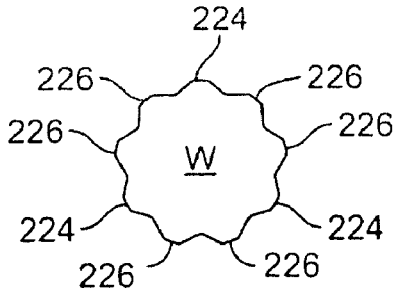

In an alternate embodiment, the inlet rollers 214 form full-radius grooves 220, and the outlet rollers 216 form grooves 222 of a different arcuate geometry such that the grooves 222 formed are not full-radius grooves, as shown in FIGS. 15-21. The fluted edge 240 of an outlet roller 216 producing such a different arcuate geometry is shown in FIGS. 15 -17. The outlet rollers 216 are positioned 120 degrees apart from one another and it is contemplated that the outlet set of rollers 216 are placed after the inlet set of rollers, FIG. 18-19. Consequently, the width across the top/peak of ridges 224 is slightly wider than the top/peak of the ridges 226, as shown in FIGS. 20-21. It is contemplated that such a groove/ridge configuration lessens the stress on the outlet rollers 216, resulting in longer tooling life. In another exemplary embodiment of the grooved wire W, the inlet rollers 214 are configured to form full-radius grooves, while the outlet rollers 216 are not. In this embodiment, the radius (depth) of each groove 220, 222 is 0.01 inches, with the diameter of the grooved wire 0.129 inches. In this exemplary embodiment, a total of nine grooves 220, 222 are formed around the circumference of the wire W, approximately forty (40) degrees apart and separated by ridges 224, 226.

Figure 22:
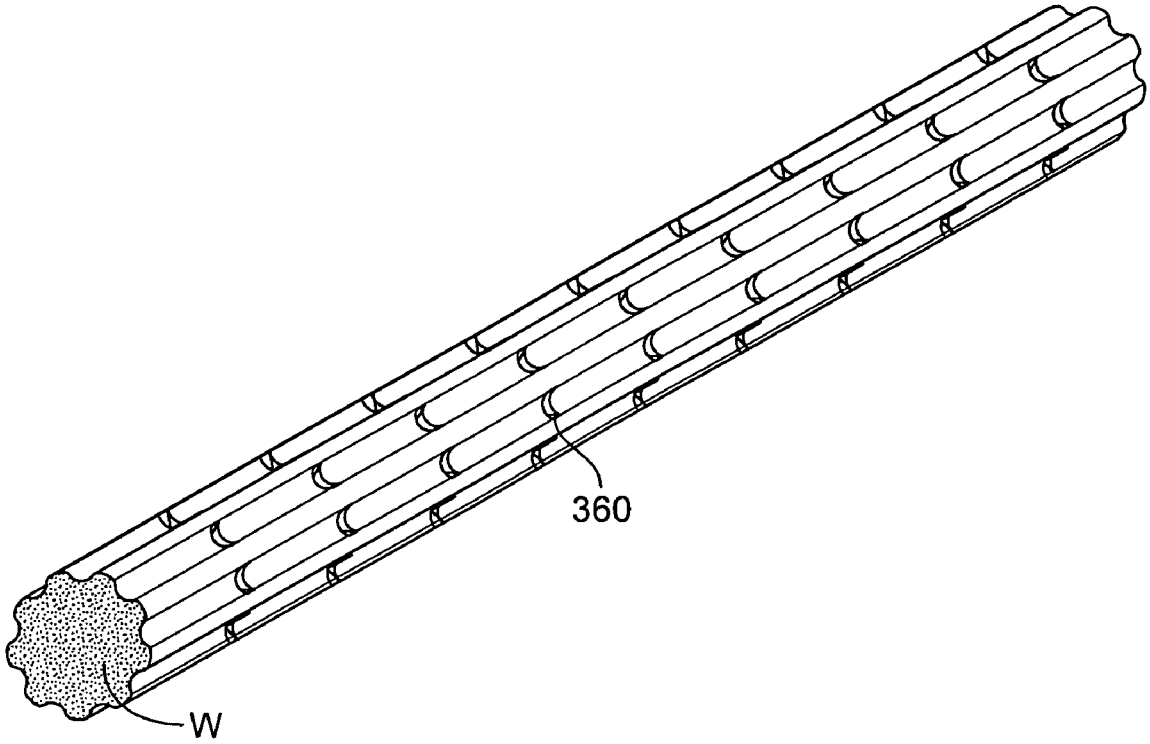
FIG. 22 is a perspective view of a wire having female cross-grooves therein made with another embodiment of the claimed invention.
Figure 23:
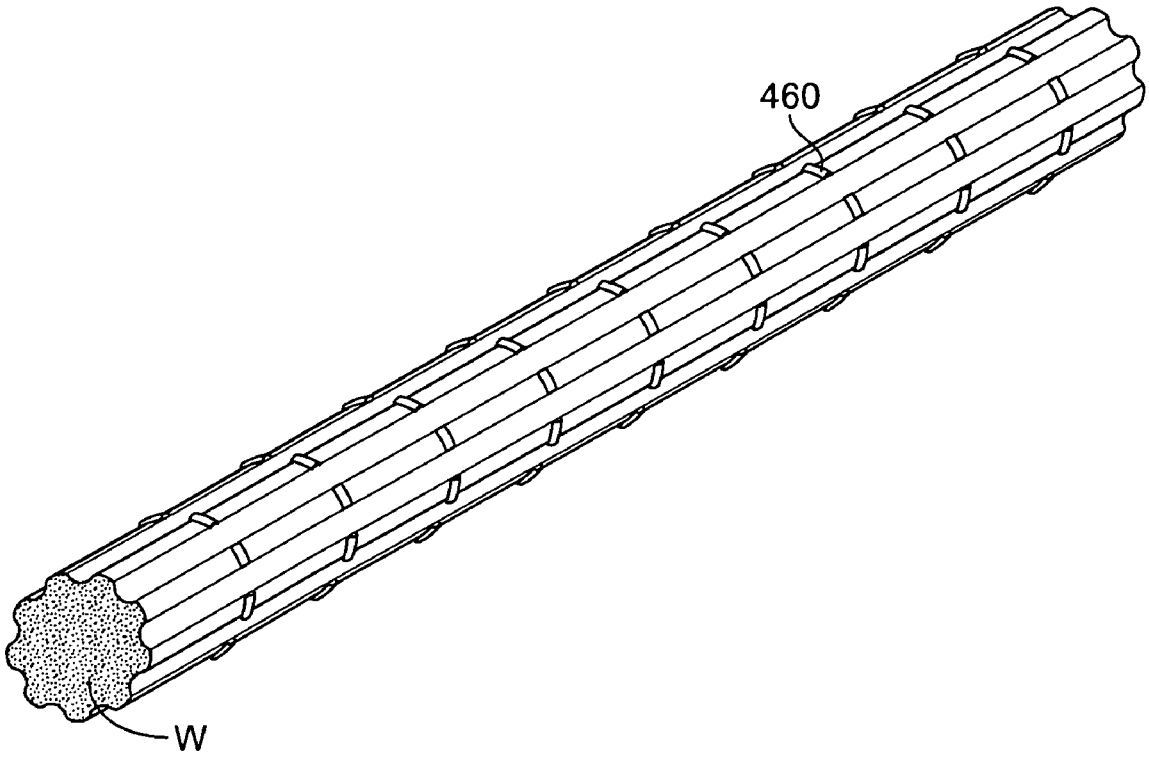
FIG. 23 is a perspective view of a wire having male cross-grooves therein made with another embodiment of the claimed invention.
Figure 24A:
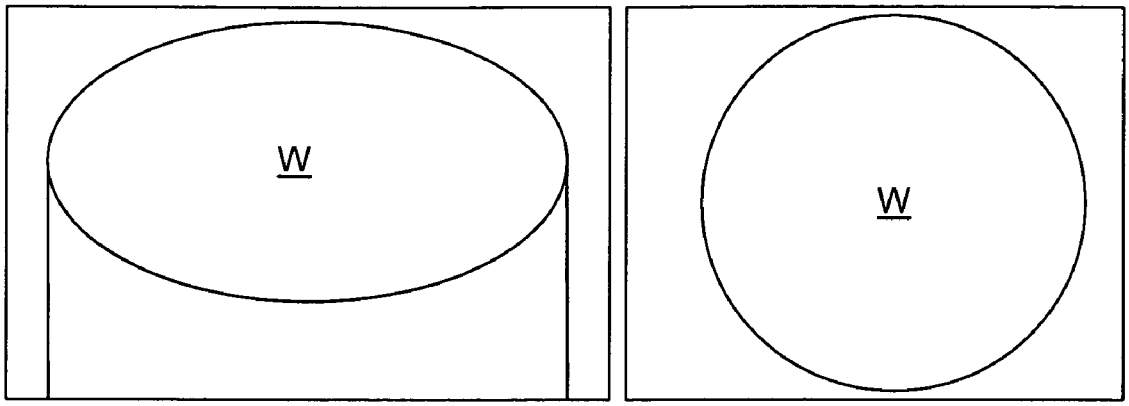
FIG. 24 is a chart illustrating the several embodiments of the wire produced by various embodiments of the claimed invention.
Figure 24B:
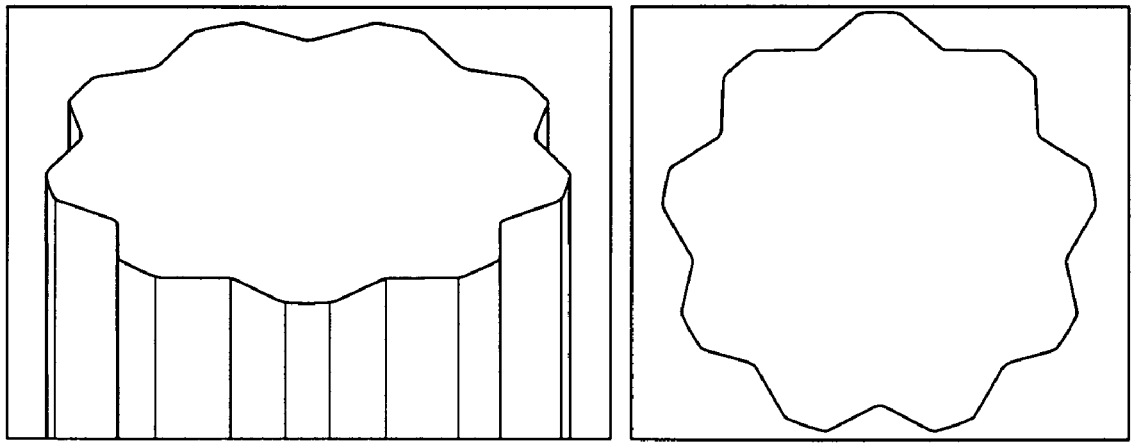
Figure 24C:
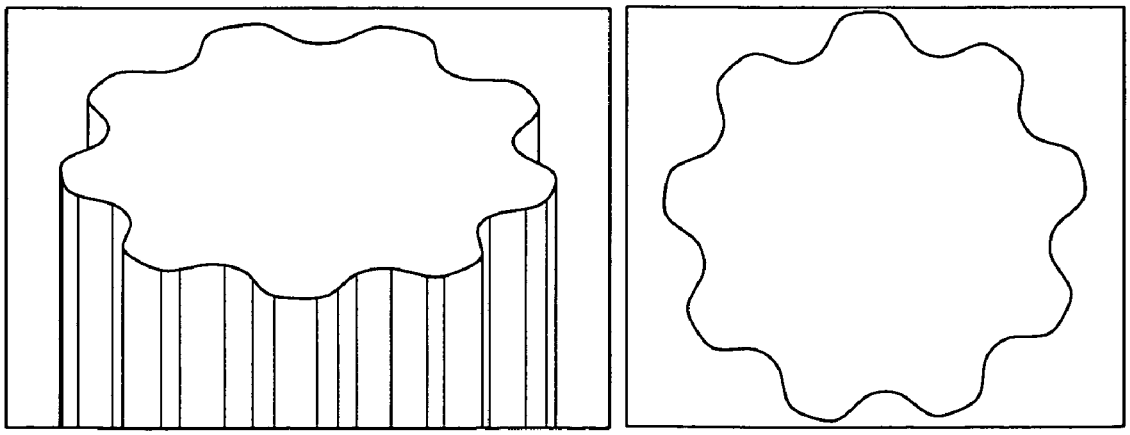

The grooves are configured to extend along the length of the wire W, however, it will be appreciated that in some embodiments, the grooves may be interrupted and/or may not extend the entire length of the wire W. In alternative embodiments of the claimed invention, such as in FIGS. 22 and 23, the grooved wire may be formed with concave 360 rings formed within the grooves or around the circumference of the wire W. In another embodiment, convex 460 rings are formed in the ridges between the grooves or along the circumference of the wire W. In either case, the rings 260, 360 may be used to alter the strength of the grooved wire W to, for example, provide increased holding (pull-out) strength, or the like, as desired. In addition, the claimed invention may be used with hot or cold rolling type manufacturing as well as other types of wire-forming technology.

The claimed invention can eliminate a considerable amount of the material needed to manufacture a wire. In doing so, the claimed invention reduces material costs without sacrificing strength or quality.

It should be noted that the preceding embodiments are just a few of many possible embodiments and are presented by way of example only. It will be appreciated that in other embodiments of the claimed invention, the number of grooves, the depth of the grooves, the diameter of the wire, and the angle between the grooves may vary depending on the gauge of the wire, and the desired material, weight, and physical characteristics of the grooved wire.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the claimed invention. It is to be understood that no limitation with respect to the specific embodiments illustrated is intended or should be inferred. The disclosure is intended to cover by the appended claims all such modifications as fall within the scope of the claims.

What is claimed is:

1. A method for forming a multiple grooved wire, the method comprising:

pulling a wire through a first set of rollers, the first set of rollers having groove-forming protrusions thereon, wherein the first set of rollers forms grooves in the wire, the first set of rollers defining gaps between the grooves; and pulling the wire through a second set of rollers, the second set of rollers having groove-forming protrusions thereon, wherein the second set of rollers forms grooves in the wire in the gaps formed by the first set of rollers.

2. The method of claim 1, wherein the first set of rollers is comprised of a plurality of rollers and each roller in the first set of rollers is spaced 120 degrees apart from an adjacent roller.

3. The method of claim 1, wherein the second set of rollers is comprised of a plurality of rollers and each roller in the second set of rollers is spaced 120 degrees apart from an adjacent roller.

4. The method of claim 1, wherein the first set of rollers produces an odd number of grooves and the second set of rollers produces an even number of grooves.

5. The method of claim 1, wherein the first set of rollers is off-set radially of the second set of rollers.

6. The method of claim 1, wherein flashing is reduced in the grooves formed by the first set of rollers.

7. The method of claim 1, wherein there are at least as many gaps between rollers of the first set of rollers as there are grooves formed by the second set of rollers.

8. The method of claim 1, wherein the protrusions of the second set of rollers are configured to pass adjacent to the grooves formed by the first set of rollers.

9. The method of claim 1, wherein a first roller in the first set of rollers has a different number of groove-forming protrusions than a first roller in the second set of rollers.

10. The method of claim 1, wherein each roller in the first and second set of rollers produce full-radius grooves.

11. The method of claim 1, wherein each roller in the first and second set of rollers produce non-full radius grooves.

12. The method of claim 1, wherein each roller in the first and second set of rollers produce grooves having a V-shaped cross-section.

13. The method of claim 1, wherein each roller in the first and second set of rollers produce grooves having a rounded cross-section.

14. The method of claim 1, wherein the first and second set of rollers produce grooves having a square shaped cross-section.

15. The method of claim 1, wherein each roller in the first and second set of rollers produce ridges in the elongated metal substrate.

16. The method of claim 1, wherein the first and second set of rollers produce grooves spaced uniformly around a circumference of the elongated metal substrate.

17. The method of claim 1, wherein the first and second set of rollers produce grooves spaced non-uniformly around a circumference of the elongated metal substrate.

18. The method of claim 1, wherein the first and second set of rollers produce ridges having a rounded peak.

19. The method of claim 1, wherein the first and second set of rollers produce ridges having a non-rounded peak.

20. A device for producing longitudinal grooves in an elongated metal substrate, the device comprising:

a first set of rollers; and a second set of rollers, wherein the first set of rollers produces one of an even and an odd number of grooves in the elongated metal substrate and the second set of rollers produces an other of the even and the odd number of grooves, the first and second set of rollers having groove-forming protrusions thereon and aligned circumferentially and parallel to a longitudinal axis of the elongated metal substrate, wherein the first and the second set of rollers are configured to produce an odd number of grooves distributed asymmetrically about a circumference of the elongated metal substrate.

* * * * *